United States Patent [19]

Diamond

[11] 4,271,991

[45] Jun. 9, 1981

[54] LOW PRESSURE DISPENSING

[76] Inventor: George B. Diamond, Anthony and Woodglen Rds. R.D., Glen Gardner, N.J. 08826

[21] Appl. No.: 964,892

[22] Filed: Nov. 30, 1978

Related U.S. Application Data

[63] Continuation-in-part of Ser. No. 877,979, Feb. 18, 1978, Pat. No. 4,171,757, and a continuation of Ser. No. 693,768, Jun. 8, 1976, abandoned.

[51] Int. Cl.[3] ..... B67D 1/04

[52] U.S. Cl. ..... 222/389; 222/387

[58] Field of Search ..... 222/389, 402.22, 402.13, 222/402.21, 327, 394, 387, 402.1; 229/4.5

[56] References Cited

U.S. PATENT DOCUMENTS

| | | | |
|---|---|---|---|
| 2,953,284 | 9/1960 | Prussin et al. | 222/402.13 |
| 3,137,416 | 6/1964 | Shepherd et al. | 222/394 X |
| 3,245,591 | 4/1966 | Kneusel et al. | 222/389 |
| 3,344,961 | 10/1967 | Graham | 222/402.22 |
| 3,581,941 | 9/1969 | Bruce et al. | 222/402.22 X |

*Primary Examiner*—Stanley H. Tollberg
*Attorney, Agent, or Firm*—Le Blanc, Nolan, Shur & Nies

[57] ABSTRACT

A low pressure container for dispensing a product, even products of high viscosity, namely about 10,000 cps. or higher, at pressures of only about 6–40 lbs. per sq. in. gauge (psig). The low pressure reduces the safety hazard to practically zero, reduces the cost of the container very substantially and minimizes the use of metals, plastics and other scarce container materials. The container is provided with an internal barrier in the form of a piston, bag, disc, or the like, to separate the product from the propellant.

The container side wall is thinner than the container ends and may be relatively thin, for example in the order of 0.0015" to 0.0045" times the diameter in the case of aluminum or steel cans. The necessary thickness of other materials (such as plastic, paperboard or laminates of metal, plastic and paper) will depend on their relative tensile strengths. The use of such thin-walled containers lowers the cost of the package and at the same time renders the side wall so flexible that the side wall conforms to the piston or other barrier which helps to prevent by-pass or escape of propellant gas and also allows the internal pressure to smooth out any dents occurring during transportation. The conformation of the wall to the barrier also permits almost complete expulsion of the product. Preferably a tilt type valve is used for speedily uncovering a dispensing outlet capable of discharging the product at a flow rate of at least 0.8 grams per second.

10 Claims, 6 Drawing Figures

FIG. 1
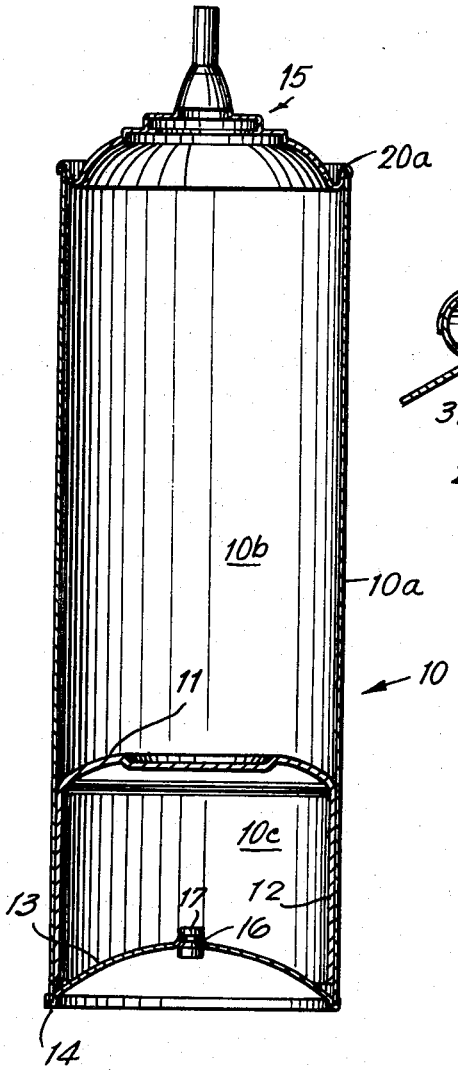
FIG. 2
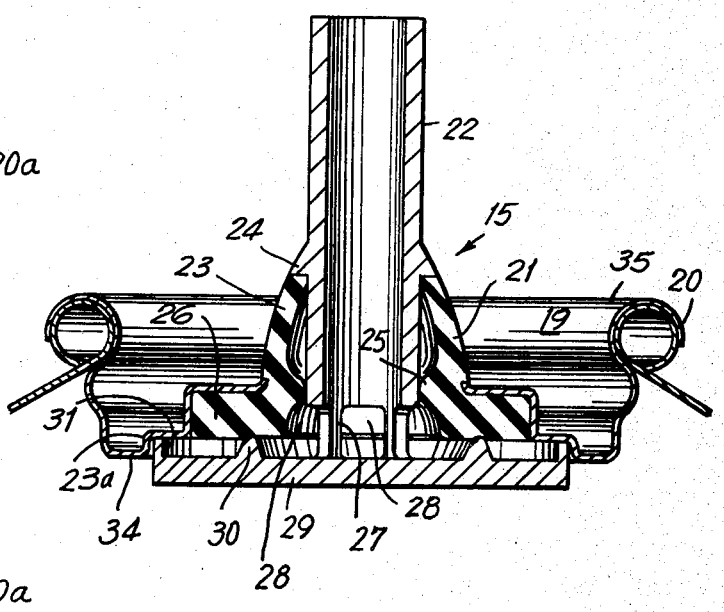
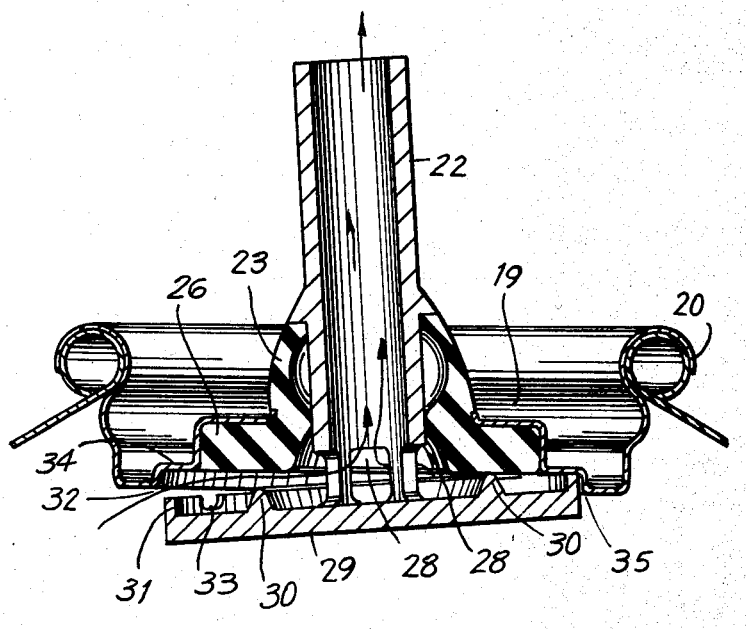
FIG. 3

LOW PRESSURE DISPENSING

This is a continuation-in-part of Ser. No. 877,979 filed Feb. 18, 1978 as a continuation of Ser. No. 693,768 filed June 8, 1976 (now abandoned). Said Ser. No. 877,979 issued as U.S. Pat. No. 4,171,757 on Oct. 23, 1979.

BACKGROUND OF THE INVENTION

In order to understand the invention, it is necessary first to consider the Regulations of the Department of Transportation as given in Tariff No. 30, entitled "Harzardous Materials Regulations of the Department of Transportation", including "Specifications for Shipping Containers".

The above regulation in Section 173.306 recognizes two types of pressure systems for metal containers.

1. For compressed gases, the container must withstand pressures of three times the pressure at 70° F.
2. For liquified gases, the container must withstand one and one-half times the equilibrium pressure at 130° F.

In determining the pressure requirements for barrier containers, account must be taken of the fact that the initial volume in the container not filled with product is about one-third of the total volume, so that if compressed gas is used, the initial pressure is three times the final (minimum) pressure. For example, if for a given product, a minimum pressure of 33 psig is needed ( and this is also, of course, the final pressure), an initial pressure of 99 psig is required and the container must withstand a pressure of three times 99 or 297 psig. Heretofore, inert gas propellants, when used, were of this magnitude, i.e., 90–100 psig.

When a liquified propellant is used in order to maintain 33 psig at 70° F., it will have a pressure of ca. 100 psig at 130° F., and the container will have to withstand a bursting pressure of ca. 150 psig. To maintain an average of 66 psig at 70°, a pressure withstanding strength of 250 psig will be needed.

Valved pressurized containers have for the most part been designed for the discharge of atomized sprays of low viscosity fluids or for the discharge of foaming low viscosity fluids. In either case, the use of initial pressures at 70° F. of ca. 35 psig for liquified gases (volatile liquids) or 100 psig for compressed gases was necessary, in order to obtain atomization or foaming. (The use of low pressure liquified gases in glass containers for the atomization of perfumes and the like required the use of high-priced propellants and valves).

When the use of barrier pressure dispensers for viscous fluids started some twenty years ago and up to the present time the only available valves and containers were small orifice valves and high pressure containers and these have been and are still in use today. The use of these containers made it necessary to warn the consumer against leaving the containers exposed to sunlight and against throwing them into incinerators or open fires because of the danger of explosion. The prior containers, therefore, had to be made of relatively rigid heavy gauge metal which increased their cost of production and transportation, and also made it difficult to eliminate denting and the by-pass or escape of the propellant.

BRIEF SUMMARY OF THE INVENTION

The present invention relates to low pressure dispensing and particularly to valved thin-walled containers for dispensing fluent products at relatively low pressure in the range of only 6 to 40 psig; and it provides articles of manufacture in the form of valved thin-walled pressurized containers of such low internal pressure as to contribute to practically complete safety, preferably pressurized containers wherein the product is separated from the propellant by a disc, piston, collapsible bag or like impermeable barrier.

This invention is concerned in an important aspect with products having a minimum viscosity of at least 10,000 cps. and whose viscosity may be as high as 500,000 cps. or more.

A container discharge valve is employed which affords such a large cross-sectional flow outlet area that a satisfactory rate of flow through the valve is attained despite low propellant pressure. By reason of the reduced pressure, the wall of the container, when of metal, may be greatly reduced in thickness as compared to conventional pressurized containers charged at 100 psig or higher, so that in addition to the lower cost of the reduced pressure gas, still further economy results from the use of smaller weights of metal or other container materials, while at the same time wastage of such material is reduced.

According to an important phase of the invention, products of high viscosity of, say 10,000 cps and above, may be packaged in a container at initial compressed gas pressures of ca. 6–40 psig at 70° F. or initial liquified gas pressures of ca. 6–24 psig at 70° F. and dispensed at flow rate of at least 0.8 grams per second.

The 6 psig compressed gas requires a pressure withstanding strength of three times or 18 psig, and the 61b. liquified gas requires a pressure withstanding strength of one and one-half times the pressure at 130° F. or 60 psig. The 40 psig compressed gas requires a pressure withstanding strength of 120 psig, and the 24 psig liquified gas also requires a pressure withstanding strength of 120 psig. Containers of the present invention accordingly do not need to have a pressure withstanding strength higher than 120 psig.

Since a compressed gas at an initial pressure of 40 psig gives a final pressure of about 13 psig, the use of liquified gas at 13 psig would give the same final flow characteristics. The pressure withstanding strength required for 13 psig liquified gas is 75 psig, but if the liquified gas is used in a novel way, described below, the pressure withstanding strength required can be reduced even further.

According to a further feature of the invention, the quantity and type of liquified gas to be used are calculated and determined, so that it is completely evaporated before the 130° F. temperature is reached, whereupon it then acts as compressed gas, giving a lower pressure at 130°, and above, than would otherwise be reached (i.e., with a continuing supply of liquid propellant), and therefore allowing even thinner walls for the package and even greater safety.

By way of example, and in accordance with the invention, there is employed, for a 6 fluid oz. container, a quantity of a volatile liquid fluorocarbon propellant, such as "Freon", less than 4 g. within the skirted piston, described hereinafter, and having a volume of about 2 oz., in contrast to the 7 to 10 g. employed in current practice for the conventional 6 oz. pressurized dispensing can, the amounts varying somewhat depending on the specific fluorocarbon. Similar reductions in the amount of a volatile liquid hydrocarbon or other liquid propellant can be made in accordance with the present invention for the purpose stated.

The limited quantity of volatile liquid propellant can be mixed with air, nitrogen or carbon dioxide which, upon becoming mixed with the maximum amount of vapor originating in the liquid propellant, will yield a mixture of gas and vapor having only the incremental increase in pressure per degree of increase in temperature, according to the gas laws. Hence, when temperature rises, the liquid propellant is completely evaporated at a pressure which is considerably below the legal limitations on pressures.

Also, according to the invention, valves of increased flow-through cross-section are used, while the container is made of much thinner metal than heretofore, similar to the containers for beverages, or a combination of metal foil and cardboard, or of plastic or laminate of cardboard and plastic film can be used, so that the cost of a valved container of 6–8 oz. capacity is in the neighborhood of 10–12 cents in contrast to the cost of 17–21 cents for the present day higher pressure valved container. In fact, a 16 oz. valved container of the invention could cost only about 13 cents, as compared to about 25 cents for a present day type valved container of equal volume, if such were available, which it is not, owing to the prohibitive cost. Since the retail cost to the consumer is from 3 to 5 times the manufacturing cost, savings to the consumer of from 20 cents to 35 cents per package are feasible.

If the cost of discarding dented containers and malfunctioning containers is also included, an even greater saving is possible since the invention also minimizes denting and malfunction.

In contrast to prior pressurized containers, with or without barrier, the above invention accordingly presents the following:

1. Economic advantages—lower cost.
2. Safety advantages—lower pressure.
3. Ecological advantages, i.e., less material is used per container, and the use of metals and plastics is conserved.
4. Denting problem is solved.

BRIEF DESCRIPTION OF THE DRAWING

FIG. 1 is a central section, partly in elevation, of a low pressure barrier container in accordance with a preferred embodiment of the invention;

FIG. 2 is an enlarged view, in central longitudinal section, of the tilt discharge valve of FIG. 1 in closed condition;

FIG. 3 shows the valve of FIG. 2 in open condition;

PREFERRED EMBODIMENTS

Figure 4:
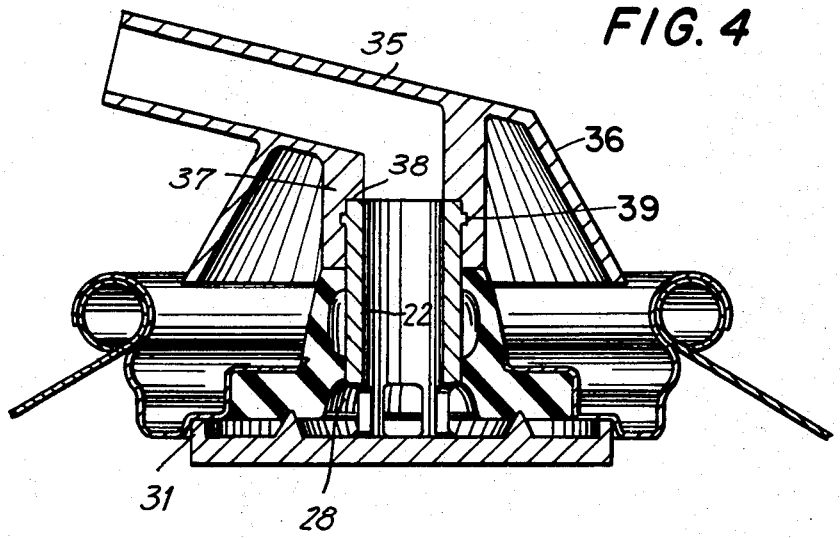
FIG. 4 is a central section through a modified form of valve.

Referring to FIG. 1, the container is indicated at 10 and is provided with a cylindrical wall 10*a*. It houses a barrier in the form of a piston 11 having a depending skirt 12. The bottom 13 of the container is sealed to the body or side wall of the container by double seaming, as indicated at 14.

The product space 10*b* of the container is filled with the product through the open cylinder at the top thereof and prior to the installation of the valve 15. After the valve structure has been sealed to the top of the container (the valve being in the closed condition), the space 10*c* below the piston 11 and within the skirt 12 is charged with a quantity of propellant at a pressure of 6 to 40 psig through a port 16 which is thereafter closed as by a plug 17 of rubber.

In accordance with the invention, and by virtue of the reduced internal pressure, the side wall of the container, and also the bottom wall thereof, may be made considerably thinner, and thus of lower weight, than such parts have heretofore been made for pressurized containers, whether of metal, plastic, paperboard or the like.

CONTAINER CHARACTERISTICS

In the invention the containers may advantageously be made of metal or a suitable synthetic plastic.

Metal containers are preferably made of aluminum or steel, the terms essentially aluminum and essentially steel including the known alloys of these metals that are conventionally used for the pressurized packaging of consumer products, such as beverages, shaving cream, fluent foods, personal care products and the like.

The metal container side walls in the invention are considerably thinner than standard cans, and the end walls may be thinner as well. Generally for metal side walls i.e., either aluminum or steel the side wall thickness may range from 0.0015 to 0.0045 times the container diameter depending upon the tensile strength of the material used. In the invention for example two inch diameter metal cans in the invention having equivalent top and bottom ends of equivalent shape have side wall thicknesses in the below defined ranges as compared to similar conventional pressurized metal containers:

| | Invention | Conventional |
|---|---|---|
| ALUMINUM | | |
| Side Walls | 0.005" to 0/009" | 0.012" to 0.018" |
| Ends | 0.012" to 0.016" | 0.016" to 0.022" |
| STEEL | | |
| Side Walls | 0.003" to 0.007" | 0.008" to 0.012" |
| Ends | 0.009" to 0.013" | 0.014" to 0.017" |

Cylindrical pressurized metal containers of the invention of conventional diameter and materials and having the foregoing wall thicknesses exhibit a noticeable side wall bulge or other deformation or actually burst when the internal pressure is 100–120 psig. Conventional pressurized containers because of the thicker walls will not exhibit a noticeable side wall bulge or deformation or burst when the internal pressure is substantially higher than 100–120 psig.

Thus, since the actual internal pressures are in the range of 6 to 40 psig, in the invention even though incapable of withstanding pressures about 120° psig or above the container side walls are of sufficient thickness to satisfy the legal limits of safety standards imposed by Government Regulations while avoiding unacceptable bulge or deformation.

Conventional pressurized containers of the above dimensions and materials have bulge or deformation pressures in the range of 150–180 psig and at 120 psig do not exhibit noticeable bulge or deformation.

In general using the same internal pressure in pressurized containers of smaller diameter the side walls may be in the lower part of the foregoing range and those of larger diameter in the upper part of the foregoing range.

Similarly for the same internal pressure and the same diameter alloys of aluminum or steel having higher tensile strengths permit thinner side walls while lower tensile strength alloys require thicker side walls.

The design of the shape of the can ends moreover has a marked effect on their ability to resist deformation from internal pressure. An efficient can end design can either increase the deformation pressure limit or when made from thinner stock maintain a desired pressure rating at lower material cost. There are however limits on end design imposed both by esthetics and economy and feasibility of production, and these same limits may also apply to the choice of material grades used to make the containers in that higher tensile strength materials are generally more expensive and more difficult to form than are materials of somewhat lower tensile strengths.

In general however pressurized metal containers made under the invention and having side wall and end wall thickness within the above range are unexpectedly satisfactory in filling, transportation, storage and customer usage, and result in very substantial material savings with attendant reduction of costs.

The tubular body 10 of the container may be formed of thermoplastic or thermosetting synthetic plastics material with a wall thickness of 0.05 or less, preferably 0.015 inch to 0.50 inch, or it may be made of cardboard with a facing of plastic or metal foil, or having a resin-treated surface impervious to gases and liquids.

The economic advantage of plastic containers with thinner walls (as permitted by the present invention), as compared to the known 0.06 inch wall, is illustrated by the following:

Polyesters and acetals sell for about 80 cents per lb. and a 2 fluid oz. plastic container weighs about 1 oz. for a 0.06 side inch wall and 0.33 oz. for a 0.02 inch side wall which is adequate in accordance with the invention, a saving of 0.067 oz. for 3.3 cents per unit.

Examples of plastics and their tensile strengths, as well as the wall thicknesses which will insure against bursting in containers having an outside diameter of 2 inches at different pressures, are listed in the following table:

| Plastic Type | Tensile Strength psi | Side Wall Thickness for 2" O.D.Cans: For 30 psi | For 100% Safety Factor | For 200% Safety Factor |
|---|---|---|---|---|
| Polyethylene, Polypropylene, Acrylonitrile-Butadiene-Styrene | 2,500 | .012 | .024 | .036 |
| Polyesters, Acrylics | 5,000 | .006 | .012 | .018 |
| Nylon, Polyesters, Polycarbonates, Acetals, Reinforced Plastics | 10,000 | .003 | .006 | .009 |

Wall thickness for 1" O.D. cans are half of the above and for other O.D.'s in proportion.

The table indicates minimum theoretical thicknesses and shows only relative strengths, and not necessarily the thicknesses that will be used practically. As a practical matter the actual thicknesses used depend upon characteristics such as creep, gas permeability and molding technologies.

There is considerable overlap of plastic strengths and the above is only a guide.

Currently available plastic barrier containers have wall thicknesses in the range of about 0.100 or more for the lower strength plastics and about 0.060 for the strongest ones. Some of the wall thicknesses in the above table may be too thin for practical use, but they can be increased to within a practical range while still remaining below 0.100 inch and 0.060 inch.

The following propellants in various admixtures can be employed in my improved pressurized packages, the proportion of liquid propellants being limited in the amounts and for the reasons set forth hereinabove.

EXAMPLES OF PROPELLANTS

Pressure range 6–30 psig.

Propellants and gases and mixtures of gases and propellants, but not limited to the following:

I. For the 30 psig. range:
- 40% propellant 12, 60% propellant 11
- 25% propellant 12, 75% propellant 114
- 20% propellant 115, 80% propellant 114
- Mixtures of propellants 22 with 113 and/or 114 and/or 21
- Propellant 318
- Hydrocarbon blends such as Butanes and Propanes with low pressure hydrocarbons such as Pentanes, i.e., both the normal hydrocarbons and their isomers
- Air, nitrogen, carbon dioxide, any other inert gas at 30 psig.

II. For the 6 psig. range:
- 12% propellant 12, 92% propellant 11
- 20% propellant 12, 80% propellant 113
- 90% propellant 114, 10% propellant 113
- Propellant 21
- Hydrocarbon blends of Penatnes with high pressure hydrocarbons such as Butanes and Propanes, i.e., both normal hydrocarbons and their isomers.
- Air, nitrogen, carbon dioxide, any other inert gas at 6 psig.

For intermediate pressure ranges, different percentage mixtures of the above propellants will be used.

The above-named propellants and the proportions of mixtures of propellants for obtaining the specified pressures were taken from the well-known DuPont chart, from which the proportions for a 40 psig charging pressure, as well as for intermediate pressures between 6 and 40 psig. can be readily obtained. Propellant 11 is Trichloromonofluoromethane

12 is Dichlorodifluoromethane
21 is Dichloromonofluoromethane
22 is Chlorodifluoromethane
114 is Dichlorotetrafluoromethane
318 is Octafluorocyclobutane
315 is Chloropentafluoroethane
113 is Trichlorotrifluoroethane The use of propellants other than air, nitrogen, or carbon dioxide is minimized in the described system, and where used will be used in smaller quantities.

As indicated above, the propellant can be either a gas at a charging pressure of 6 to 40 psig, or a volatile liquid at a charging pressure of 6 to 24 psig, or a mixture of a gas at the just-mentioned pressure with a liquid propellant, the liquid in any case being in the limited amount which will all be evaporated to the vapor state before the temperature reaches 130° F.

In the filling of the container, there is provided the cylindrical shell which is open at the top and has a bottom wall which is either integral with the shell or is secured thereto in gas-tight manner. The bottom wall contains a charging port while the shell is provided with the barrier, preferably in the form of a hollow piston open at its bottom and occupying about one-third of the container interior. The product to be dispensed is then introduced through the open upper end, and the valve assembly is secured to the shell in leak-proof manner. The propellant is now charged into the piston through the port in the bottom wall, after which the port is plugged or otherwise sealed.

There may be provided sufficient clearance between the skirt 12 and the interior surface of the container 10*a* to allow some of the product to enter the clearance space and form a seal between the propellant which is contained in the space 10*c* and the produce occupying the space 10*b* above the piston.

With the container filled at reduced pressure as above described, there is employed a discharge valve capable of delivering the product at an acceptable rate both at the original pressure and even as the pressure falls on successive discharges.

Satisfactory valves for use in combination with the above-described containers and having the necessary high flowthrough capacity within the limited confines of the valve cup, or equivalent structure, are illustrated by way of example in FIGS. 2 to 5.

Figure 6:
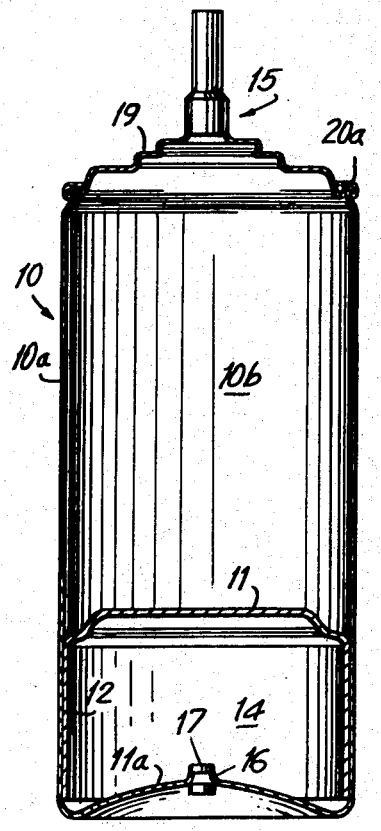
FIG. 6 is a view similar to FIG. 1 showing a modified container having an integral bottom.

The valve body includes a metallic, preferably aluminum, frame or cup 19 which can be crimped to the top edge of the body 10*a*, as indicated at 20, or double-seamed to the top edge of the cylinder, as shown at 20*a* in FIG. 6.

Referring particularly to FIG. 2, the valve includes the body of resilient rubber 21, or the like, which is sealed to the stem 22 through which the product is discharged on opening of the valve. The body 21 includes a bowed portion 23 of annular cross-section whose upper edge abuts against the shoulder 24 formed on the stem 22, thereby providing a seal at such region, and also a point of compression when the stem is tilted. The portion 23 of the valve body is arched downwardly and is then turned inwardly, as shown at 25, to form a further seal with the bottom portion of the stem 22. The body 21 has an extension in the horizontal direction to form an annular seat 26 whose function will be described hereinafter.

The bottom of the valve stem 22 is in the form of spaced posts 27 providing passageways or ports 28 therebetween which lead into the interior of the valve stem. The bottom ends of these ports are rigidly secured to a stiff circular valve head 29. The head 29 is provided with an annular sealing rib or ring 30 which normally penetrates into the seat 26 to provide a seal between the interior 10*b* of the container and the interior of the stem 22. The sealing ring 30 is located between the center of the valve head and its periphery. The raised edge 32 is provided with a number of notches 33 to facilitate flow of product above the ring 30 when the valve is opened, the edge 31 then functioning principally as the fulcrum and as a spacer.

It will be evident from FIG. 3 that upon tilting of the stem 22 in any direction, the head 29 will fulcrum about its perimeter and particularly at the raised edge 31 at a considerable distance from the longitudinal axis of the stem, so that (as is shown at 32 in FIG. 3) a large opening is made available for the discharge of the product from the interior 10*b* and into the stem 22.

Upon the tilting of the stem 22, the portion of the body 23 of the valve located in the direction of tilt is compressed, so that upon release of the stem, the latter is returned to its normal vertical position. When this occurs, the valve head 29 is returned into its closed condition in which the sealing ridge 30 is pressed into the seat 26. In the open condition of valve head 29, the product flows into the passageway 32 through which it bypasses the seal 30, where part of such seal remains in engagement with the seat.

It will be evident that when the stem 22 is tilted, its bottom end posts 27 tilt the valve head 29 downwardly, so that the product is able to pass between the raised edge 31 and the bend 34 in the valve cup. The resilience of the vertical portion 23 of the valve body enables the valve head to return to the closed, sealing position when the stem is released.

The modification of FIG. 4 facilitates the side discharge of the product. In this embodiment, the valve stem fits at its upper end into a sleeve 37 forming part of a laterally directed nozzle 35 which is provided with a downwardly extending hood 36 serving to shield the valve. The sleeve 37 presents a shoulder 38 against which stem 22 abuts, an annular groove being provided in the portion 37 for receiving an O-ring 39 of rubber or the like, to seal the valve stem at such point. In other respects, parts corresponding to the valve parts shown in FIGS. 2 and 3 are similarly numbered, and function in the same way.

It will be noted that, as in FIGS. 2 and 3, the raised edge 31 of the disc abuts against a downwardly extending portion of the valve cup to prevent side movement of the valve head upon tilting of the stem.

As is shown in FIG. 4, by reason of the fact that the hinge of the disc 29 is disposed at a rather large distance from the central axis of the valve stem, a small degree of tilt of the stem results in quite a large opening of the valve about its raised edge, thereby affording the valve a large flow capacity.

Figure 5:
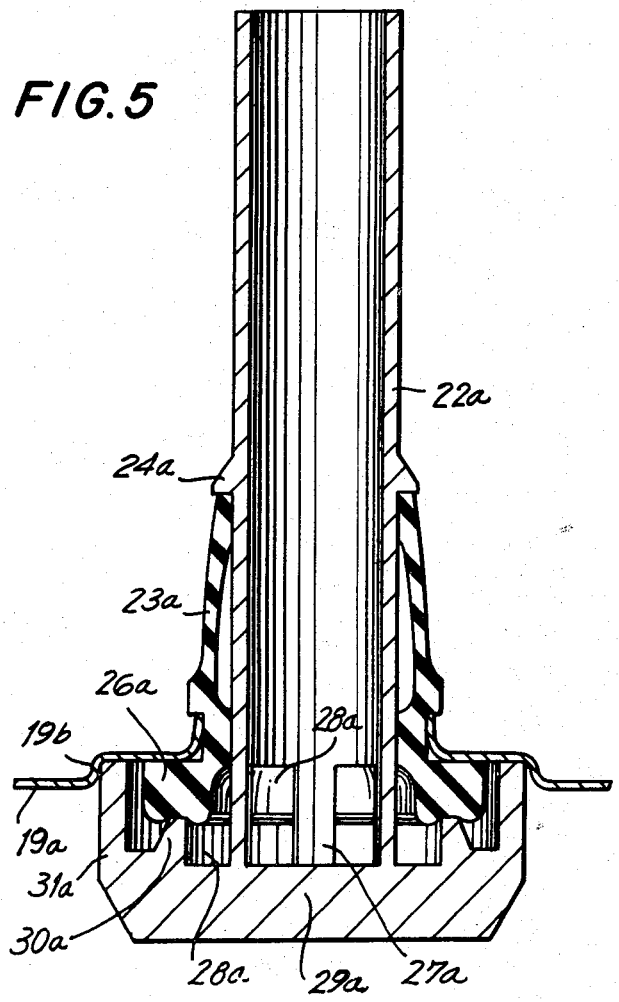
FIG. 5 is a central section through a further valve modification.

An even larger path for the product is provided for a given angle of tilt in the modification of FIG. 5, wherein the fulcruming ring on the periphery of the valve head extends considerably above the bottom surface of the seat, and in the tilting action of the head engages a portion of the valve cup beyond the periphery of the valve seat, thereby increasing the radii of tilt both of the sealing ring and of the fulcruming ring.

As shown in FIG. 5, the parts corresponding to those shown in FIGS. 2, 3 and 4 are indicated by the same numerals but with the letter "a" attached.

The principal differences of FIG. 5 over the structures of FIGS. 2, 3 and 4 reside in the greater height of the fulcruming ring 31*a* than the sealing ring 30*a*, the top of the ring 31*a* being also considerably higher than the bottom surface of the valve seat 26*a*, and in the greater radius of tilt of the valve head.

As in the other figures, the sealing ring 30*a* spaces the top surface of the valve head 29*a* from the bottom surface of the valve seat 26*a*, which allows the ports 28*a* to extend for a considerable distance below the bottom of the valve seat.

The fulcrum ring 31*a* extends to a shoulder 19*b* of the valve cup, it being immaterial whether the ring exercises a sealing function against the valve cup or not. However, the shoulder 19*b* serves to center the valve head and prevents lateral displacement thereof on tilting of the valve stem 22*a*.

Upon tilting of the stem 22*a* in any direction, the ring 31*a* will fulcrum against the shoulder 19*b* and will effect a relatively large opening movement in the region of the diagonally opposite point of the ring 31*a* from its fulcrum by reason of the larger diameter of the valve head than its seat and the location of the fulcrum above the seat; so much so, that all of the sealing ring 30*a* is quickly separated from the valve seat on tilting of the stem 22*a*, and the product has access to all the ports 28*a* throughout the full 360°, with resultant low resistance to flow through the valve.

As in the other embodiments, the spacing of the top surface of the valve head from the bottom surface of the valve seat enables larger ports 28*a* to be easily provided at the bottom of the stem, i.e., they can be of increased height and hence afford increased flow cross-sectional area.

The valves above described have a much greater rate of discharge of viscous materials of 10,000 cps. and above at the reduced pressures than the known Clayton valve operating with a container charged at the same reduced pressure with the same materials. Thus, a Clayton valve employed with a pressurized container partly filled with a cheese preparation having a viscosity of about 300,000 cps, the valve having 3 openings at the bottom of the stem, each of about 0.09 inch in diameter delivered at 20 psig, a flow rate of only 0.2 g. per second, which is not acceptable for cheese.

The valves described herein and likewise provided with 3 ports at the same location in the vertical stem as in the Clayton valve, yielded a flow rate for the same cheese preparation of 0.8 g. per second at 20 psig, which is an acceptable rate.

FIG. 6 shows a pressurized container in which the bottom wall is not in the form of a separate member, crimped or doubleseamed to the bottom edge of the container sidewall or shell, but is constructed in the manner of a beer can in which the bottom is integral with the side wall of the container. However, the bottom 11*a* is provided with a charging port 16 as in FIG. 1, for charging the propellant under pressure, after which the port is sealed with the usual plug 17.

The considerably lower cost of pressurized valved package of the invention has been emphasized hereinabove.

Specifically, in the case of toothpaste tubes, which at present are non-pressure packages, the largest practical size is 8 oz. and costs 10–11 cents (for the collapsible tube). In the quantities used by toothpaste manufacturers, my improved pressure pack can be sold at about the same price. Larger economy size toothpaste tubes are not marketed because they are too combersome to handle. A low pressure barrier pack which will hold 12 oz. of toothpaste can be more easily handled and will costs 13–14 cents, which is about 1.125 cents per oz. This means that 12 oz. of toothpaste can be sold (including paste) for substantially less per oz. than collapsible 8 oz. tubes.

Similarly, significant economics will be obtained in the pressurized packaging of other fluent materials of viscosities of 10,000 cps and above, such as cheese, spreads, greases, lubricants, hair pomades, and the like. In general, charging pressures of 10 to 15 psig will be adequate to yield satisfactory rates of discharge for the viscous materials provided that a high capacity discharge valve, such as above described, is employed.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. As an article of manufacture, a self contained, pressurized barrier container having a thin side wall and thin end walls that are of materially reduced thickness as compared to a conventional pressurized container and will not withstand internal pressures above 120 psig, said container being sealed at the bottom end and having a discharge valve at the other end, a movable member in the container serving as a gas tight sealing barrier therein for defining two chambers, one chamber communicating with the valve and containing a product for discharge at the pressure of a propellant within the other chamber of the container, said member having such strength as to conform to the wall of the container and also to seal therewith and said side wall being sufficiently flexible as to conform to said member, and said valve being so constructed, on opening, as to afford an effective flow-through cross-sectional outlet area allowing a useful rate of discharge of at least 0.8 g per second at the propellant pressure and maintaining an effective flow rate at the reduced pressures following incremental discharges from the container; said container side wall and end walls being composed of a metal selected from the group consisting of aluminum and steel, with the side wall thickness being in the range of 0.003" to 0.009", and the bottom end wall thickness being in the range of 0.009" to 0.016".

2. An article of manufacture according to claim 1, wherein said movable member is a piston in peripheral sliding engagement with the container side wall.

3. The article of manufacture defined in claim 1, wherein the container side wall is aluminum having a thickness in the range of 0.005" to 0.009" and the bottom end wall is aluminum having a thickness in the range of 0.012" to 0.016".

4. The article of manufacture defined in claim 1, wherein the container side wall is steel having a thickness in the range of 0.003" to 0.007" and the bottom end wall is steel having a thickness in the range of 0.009" to 0.013".

5. The article of manufacture defined in claim 1, wherein the container contains a product to be discharged and said product has a viscosity of at least 10,000 cps.

6. An article of manufacture according to claim 1, wherein the charging pressure is 6 to 40 psig.

7. An article of manufacture according to claim 6, wherein the pressure within the container is at least 20 psig and wherein the product viscosity is at least 300,000 cps.

8. As an article of manufacture, a self contained, sealed pressurized barrier container formed of flexible material and sealed at one end wall and having a discharge valve at the other end wall, said container having a side wall of aluminum, and the thickness of said side wall in inches is approximately equal to the product of the container diameter in inches multiplied by 0.0015 to 0.0045, and the bottom end wall being of aluminum having a thickness in the range of 0.012" to 0.016", a movable barrier in the form of a piston in the container and serving as a gas tight sealing barrier therein for defining two chambers, one chamber communicating with the valve and containing a product for discharge at the pressure of a propellant within the other chamber of the container, the piston having such strength as to conform to the wall of the container and also to seal therewith, said propellant when gaseous having an initial charging pressure in the range of 6 to 40 psig and when liquified gas having an initial charging pressure of 6 to 24 psig, both at room temperature, the valve being constructed, on opening, to afford an effective flow-through cross-sectional area allowing a useful rate of discharge of at least 0.8 g per second at the said pressure and maintaining an effective flow rate at the reduced pressures following incremental discharges from the container.

9. As an article of manufacture, a self-contained, sealed pressurized barrier container formed of flexible material and sealed at one end wall and having a discharge valve at the other end wall, said container having a side wall of steel, and the thickness of said side wall in inches is approximately equal to the product of the container diameter in inches multiplied by 0.0015 to 0.0045, a movable barrier in the form of a piston in the container and serving as a gas tight sealing barrier therein for defining two chambers, one chamber communicating with the valve and containing a product for discharge at the pressure of a propellant within the other chamber of the container, the piston having such strength as to conform to the wall of the container and also to seal therewith, said propellant when gaseous having an initial charging pressure in the range of 6 to 40 psig and when liquified gas having an initial charging pressure of 6 to 24 psig, both at room temperature, the valve being constructed, on opening, to afford an effective flow-through cross-sectional area allowing a useful rate of discharge of at least 0.8 g per second at the said pressure and maintaining an effective low rate at the reduced pressures following incremental discharges from the container.

10. The article of manufacture defined in claim 9, wherein said bottom end wall is of steel and has a thickness in the range of 0.009" to 0.013".

* * * * *